United States Patent [19]

Kii

[11] 4,270,034

[45] May 26, 1981

[54] PUFFER TYPE CIRCUIT INTERRUPTER

[75] Inventor: Masami Kii, Amagasaki, Japan

[73] Assignee: Mitsubishi Denki Kabushiki Kaisha, Amagasaki, Japan

[21] Appl. No.: 889,982

[22] Filed: Mar. 24, 1978

[30] Foreign Application Priority Data

| | | | |
|---|---|---|---|
| Mar. 24, 1977 | [JP] | Japan | 52/32901 |
| Mar. 24, 1977 | [JP] | Japan | 52/32902 |
| Mar. 24, 1977 | [JP] | Japan | 52/32909 |
| Mar. 24, 1977 | [JP] | Japan | 52/32915 |
| Mar. 24, 1977 | [JP] | Japan | 52/32926 |
| Mar. 24, 1977 | [JP] | Japan | 52/32929 |
| Mar. 24, 1977 | [JP] | Japan | 52/32931 |
| Mar. 24, 1977 | [JP] | Japan | 52/32932 |
| Mar. 24, 1977 | [JP] | Japan | 52/32934 |
| Mar. 24, 1977 | [JP] | Japan | 52/32935 |
| Mar. 24, 1977 | [JP] | Japan | 52/36165[U] |
| Mar. 24, 1977 | [JP] | Japan | 52/36166[U] |
| Jun. 14, 1977 | [JP] | Japan | 52/70687 |
| Jul. 21, 1977 | [JP] | Japan | 52/88074 |

[51] Int. Cl.[3] ..... H01H 33/82

[52] U.S. Cl. ..... 200/148 R; 200/148 C; 200/150 D

[58] Field of Search ..... 200/148 R, 148 A, 148 B, 200/148 C, 148 D, 148 E, 148 F, 148 G, 148 H, 148 J, 148 BV, 144 R, 149 A, 150 R, 150 A, 150 H, 150 J, 150 JA, 150 L, 150 M, 150 N, 150 B, 150 C, 150 D, 150 E, 150 F, 150 G, 151

[56] References Cited

U.S. PATENT DOCUMENTS

| | | | |
|---|---|---|---|
| 2,409,723 | 10/1946 | Terry | 200/150 M |
| 2,612,576 | 9/1952 | Lange | 200/150 B |
| 3,839,613 | 10/1974 | Tsubaki et al. | 200/150 G |
| 3,975,602 | 8/1976 | Hertz et al. | 200/148 A |
| 4,046,979 | 9/1977 | Hertz et al. | 200/148 A |
| 4,139,752 | 2/1979 | Itai et al. | 200/148 G X |

FOREIGN PATENT DOCUMENTS

| | | | |
|---|---|---|---|
| 695436 | 8/1940 | Fed. Rep. of Germany | 200/150 D |

OTHER PUBLICATIONS

Japanese Utility Model Publication No. 29345/1972 to Iwamoto et al.

Japanese Utility Model Publication No. 42465 to Iwamoto et al.

*Primary Examiner*—J. V. Truhe

*Assistant Examiner*—Morris Ginsburg

*Attorney, Agent, or Firm*—Oblon, Fisher, Spivak, McClelland & Maier

[57] ABSTRACT

A circuit interrupter comprises a pair of contacts which can be relatively moved to be detouchable in a fluid for arc extinction; a pressure chamber which is connected to an arc space to contain the fluid for arc extinction whose pressure is raised in the arc space; and a fluid passage which is closed until moving one contact for a specific distance and is opened to discharge the fluid in the pressure chamber through the arc space out of the pressure chamber after departing the contact for the specific distance whereby the arc extinction is performed by the puffing of the fluid.

29 Claims, 18 Drawing Figures

PUFFER TYPE CIRCUIT INTERRUPTER

BACKGROUND OF THE INVENTION

1. Field of the Invention

The present invention relates to a circuit interrupter for performing the arc extinction by puffing a fluid for arc extinction such as $SF_6$ gas. More particularly, it relates to a self-arc extinction type circuit interrupter in which high pressure fluid whose pressure is raised by an arc formed between contacts is used for performing the arc extinction.

2. Description of the Prior Arts

In the conventional circuit interrupters, a fluid having high arc extinct property is used and the fluid is puffed to the arc so as to diffuse and to cool the arc in order to improve the arc extinct function.

It has been proposed to employ the puffer system actuating a puffer device while interlocking to the interrupting operation; or the double pressure system maintaining high pressure source by a compressure in the normal state and opening a valve while under interlocking to the interrupting operation in order to give high puffing effect.

Thus, the puffer system requires large power for the operation because the puffer device is mechanically operated while interlocking to the interrupting operation. However, the puffer device requires large power for the arc extinction and the required power is increased depending upon the arc current whereby the operating device should be large size and the strength of the transmitting mechanism should be high. Moreover, in the interruption under no load or small arc current as main operations, the puffer load is quite small. In the mechanism having high operating power, excess operating power is caused to accelerate in abnormal condition whereby excess puffer action is given for the interrupting current and remarkable current interrupting is caused in a large capacity type apparatus and the abnormal voltage is generated. There are various disadvantages from the practical and economical viewpoints.

In the double pressure system, the double pressure system structure, the attachment such as a valve and a compressor and the control devices thereof are needed to cause the disadvantage of the larger size and the complicated structure.

In order to overcome the disadvantage of the conventional apparatus, it has been proposed to employ a new system in which a high pressure source is formed by the pressure raising effect of the arc mainly the heat energy thereof and the high pressure fluid is puffed to the arc space during the time decreasing the arc current to zero to perform the arc extinction.

In the self-arc extinction type interrupter, the pressure of the gas in the arc extinct chamber containing the contactors is raised by the arc energy given through the gas for arc extinction and the arc and the high pressure gas is stored in a chamber having suitable volume and the high pressure gas in the chamber is discharged to the arc space depending upon the sudden pressure drop in the arc during the time decreasing the arc current or the release or elimination of the closing function thereof, whereby the gas flow is maintained for suitable time to perform the arc extinction.

In these interrupters, in order to effectively raise the pressure of the gas for arc extinction, a fixed contact and a movable contact are disposed in the arc extinct chamber which is in substantially closed condition and an outlet disposed at the lower end of the arc extinct chamber is substantially closed by the movable contact at the time departing the contacts, and the nozzle for discharge is formed after passing the movable contact through the outlet during the interrupting operation.

In the system, the high pressure source is mainly formed by the heat energy whereby the high pressure fluid is heated at high temperature.

When the fluid for arc extinction is heated to high temperature, the density of the fluid is minimized which accelerates the ionization and decreases the insulation and the diffusion effect and the cooling effect whereby the arc extinct effect is not highly decreased.

In the phenomenon, the temperature is raised depending upon increasing the pressure raising effect to raise the pressure and to improve the function, whereby the conductivity is remarkably increased to decrease the arc extinct effect. As the result, the effect is limited and it is difficult to prepare a device having large capacity.

Even though the interrupting current is large and the pressure in the arc extinct chamber is enough to perform the arc extinction in these structures, the pressure in the arc extinct chamber is raised to the abnormal state until passing the movable contact through the outlet to form the nozzle. Moreover, the arc is expanded too much whereby it is necessary to use the material having high mechanical strength as the parts of the arc extinct chamber and to have the complicated structure. Moreover, since the consumption of the contact is large, the exchange of the contact should be frequent and the practical function is inferior disadvantageously.

When the position of the opening part of the outlet is decided so as to fit to the large current interruption, it is not easy to give high pressure in the arc extinct chamber in the small current interruption. For example, when the recovery voltage after the interruption is remarkably high as in the case of switching a capacitor bank, the interrupting effect is inferior.

The maintenance of the pressure is important in both the direct system and the indirect system. In the conventional direct system, the structure is simple and economical, however, the temperature of the fluid in the arc extinct chamber is raised because the fluid heated in the arc space is charged for raising the pressure in the arc extinct chamber. Accordingly, the density of the fluid, the diffusion effect, the cooling effect and the insulation are decreased whereby the arc extinct effect is inferior disadvantageously.

When the interrupting current is large and a remarkably large amount of energy is fed into the arc space, if all of the energy is used as the source for raising the pressure, the pressure of the fluid for arc extinction is remarkably raised and the arc voltage is increased and the arc energy is increased and the fluid filled in the arc space is further heated to result the fluid at high temperature whereby the pressure is further raised.

When the fluid for arc extinction is heated to high temperature, the insulation is usually lost to result in an increase of the electric conductivity and the insulation recovery is inferior. Moreover, the density of the fluid is decreased and the diffusion of the energy in the arc space is low and the rapid cooling of the fluid heated to high temperature is not easily attained. Accordingly, it has been difficult to improve the function and to increase the capacity in the conventional apparatus.

Moreover, in the conventional apparatus, the mechanism for raising the pressure mainly relies on the direct heating by the arc whereby the heating effect is given for raising the pressure and the temperature of the fluid in the space is raised. The high temperature of the fluid causes the decrease of the density and the ionization is promoted by the thermal ionization, and the diffusion and cooling effects are remarkably decreased and the arc extinct effect is decreased. Accordingly, it is preferable to form the high pressure fluid and to cool the high pressure fluid.

Incidentally the high pressure fluid is obtained mainly dependent on the high temperature. However, the arc itself is movable and has irregular form and the condition of the arc can be varied at relatively high speed depending upon the environmental condition. Accordingly, the fluid whose pressure is raised by the irregular arc causes the turbulent condition and the fluid is not smoothly flowed under the pressure releasing condition and the arc extinct effect is unstable in comparison with the outer operation system such as the puffer system.

In order to improve the interrupting effect in the case of a small interrupting current and slowly raising the pressure in the arc extinct chamber, it is necessary to prolong the closing time for passing the movable contact through the outlet.

In order to improve the interrupting function in the case of large interrupting current, the outlet is rapidly opened to prevent excess raising of the pressure in the arc extinct chamber whereby the damage of the parts and the abnormal consumption of the contact should be prevented.

Moreover, when the operation of the movable contact is affected by the variation of the interrupting current, to vary the pressure and to cause electromagnetic acceleration, the timing for opening and closing the outlet is further varied. Accordingly, it is difficult to obtain a circuit interrupter which has practically stable interrupting effect in a wide range from large current to small current.

When the pressure is raised too much in these systems, the arc space is heated to high temperature to raise the temperature of the fluid even though it should impart low temperature and high pressure on the spaces. Accordingly, the thermal dissociation of the fluid in the space is caused and many ionized particles are introduced to remarkably decrease the arc extinct effect, and it is difficult to practically use it.

It is necessary to prevent the decrease of the arc extinct effect by resulting the condition of low temperature and high pressure in the space for the high pressure source and to control the increase of the thermal dissociation i.e. the increase of ion density, in these systems. However, in the self-arc extinction type apparatus, the temperature of the fluid in the space as the high pressure source, is raised in each interrupting operation with the residual heat energy. When the interruption is repeated for a short time, the fluid at high temperature is accumulated to decrease the arc extinct effect.

In the structure having plural spaces as the high pressure source, the residual heat energy is highly remained at the upper space.

In a single space, the fluid at high temperature remained at the upper part of the space because of buoyancy resulted by decreasing the density of the fluid.

In the self-arc extinction type, the pressure raising is an important factor. However, the pressure raising mechanism mainly relies on the heat energy of the arc. Accordingly, the heat transfer is caused by raising the pressure to raise the temperature of the fluid in the space at high degree. The arc extinct effect at the pressure releasing is decreased by the raising of the temperature. When the temperature is raised over a specific level, the arc extinct level is substantially lost. Accordingly, it is necessary to consider the heat energy problem as well as the pressure problem.

When the pressure is raised too high, the arc space and the high pressure fluid for the arc extinction are heated to high temperature. When the fluid is heated over a specific level, the decrease of density and the ionization formed by the thermal dissociation are rapidly caused whereby the arc extinct effect is remarkably decreased.

SUMMARY OF THE INVENTION

The invention is to provide a circuit interrupter having stable operating function and excellent arc extinct effect in a wide range of the current which has a simple structure with small number of parts in a compact form and can be operated with small operation power.

The circuit interrupter of the present invention comprises a pair of contacts in an arc extinct chamber filled with a fluid for arc extinction such as $SF_6$ gas wherein the arc extinct chamber is converted from the closed condition to the opening condition at the time departing the contacts over a specific distance, whereby excellent interrupting effect is attained regardless of the rated current and the interrupting current in a simple structure.

In one embodiment, a movable contact is formed in a hollow cylindrical shape to form a passage and a nozzle is formed at the end and an outlet is formed at the other end of the passage and is disposed so as to close the outlet until suitable interrupting position whereby excellent interrupting effect is attained.

In the circuit interrupter of the present invention, a pressure chamber for containing high pressure fluid resulted by the arc without forming the arc space in the chamber, is disposed adjacent to the arc extinct chamber body in which a pair of detouchable contacts are disposed and the fluid for arc extinction is filled whereby the arc extinction is performed by puffing the high pressure fluid in the pressure chamber and excellent arc extinct effect is attained in a simple structure. In the other embodiment, the pressure chamber is disposed at upper-flow position to the arc space whereby the pressure and thermal controls of the pressure chamber by the arc space are easily attained and the interrupting effect is further improved.

The present invention is also to provide a circuit interrupter having high pressure and large capacity in a compact and simple structure wherein in order to effectively raise the pressure required for the interruption to prevent excess level, the energy diffusion from the arc extinct chamber is controlled to result high pressure fluid at low temperature whereby the arc extinct effect is improved.

In the other embodiment, a fluid for arc extinction is filled in an arc extinct chamber in which a pair of detouchable contacts are disposed, and a pressure chamber made of a heat conductive material is formed and a high pressure fluid resulted by the arc formed between the contacts fills in the compression chamber and the arc extinction is performed by puffing the high pressure fluid in the pressure chamber whereby excellent interrupting effect is attained in a simple structure.

In the other embodiment of the circuit interrupter of the present invention, a pair of the detouchable contacts are disposed in a chamber filled with the fluid for arc extinction which is heated by the arc formed between the contacts to raise the pressure and a circular cone shape surface as the guide for discharging the high pressure fluid at the time departing the contacts over a specific distance, whereby excellent interrupting effect is attained in a compact and economical structure.

In the other embodiment of the present invention, a pair of the detouchable contacts are disposed in the arc extinct chamber in which the fluid for arc extinction such as $SF_6$ is filled and the arc extinct chamber is opened at the time departing the contacts over a specific distance and raising the pressure over a specific level whereby stable interrupting effect is attained regardless of the interrupting current in a simple structure without a mechanical operating part such as a puffer device.

In the other embodiment of the circuit interrupter of the present invention, a pair of detouchable contacts are disposed in the arc extinct chamber which is disposed in the container and is filled with the fluid for arc extinction and the arc extinct chamber is sequentially connected to the container depending upon the movement of the movable contact, whereby the pressure and temperature of the arc space can be controlled and the capacity can be increased in a simple structure.

In the other embodiment of the circuit interrupter of the present invention, the first arc extinct chamber filled with the fluid for arc extinction is disposed in the container filled with the fluid, and the second arc extinct chamber comprising a pair of the detouchable contacts is disposed in the first arc extinct chamber and the high pressure fluid resulted in the second arc extinct chamber by the arc formed between the contacts is fed through a counter-flow control means to the first arc extinct chamber, whereby a large capacity can be given in a compact and economical structure.

In the other embodiment of the circuit interrupter of the present invention, a pressure valve is used to connect at least the highest space among the plural spaces as high pressure sources in the normal state so as to rapidly discharge the fluid at high temperature remained in the space and is used to close the opening part depending upon raising the inner pressure and the upper surface of the space is formed in slant from the pressure valve at the top so as to prevent the residue of the raised fluid in the space to rapidly discharge it whereby enough arc extinct effect is attained even though the interrupting operation is repeated.

Figure 1:
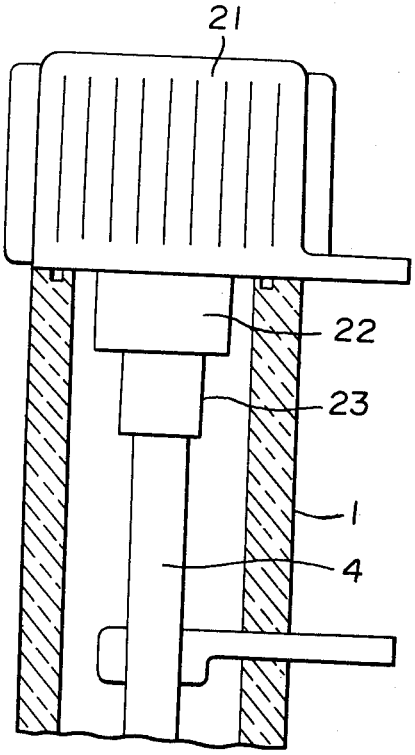
FIG. 1 is a partially blocken front view of an important part of one embodiment according to the present invention.

In the description of the embodiments, the term of a gas for arc extinction is used as the fluid for arc extinction.

In the drawings, like reference numerals designate identical or corresponding parts.

DETAILED DESCRIPTION OF THE PREFERRED EMBODIMENTS

Referring to the drawings, the embodiments of the present inventions will be illustrated in detail.

Figure 2:
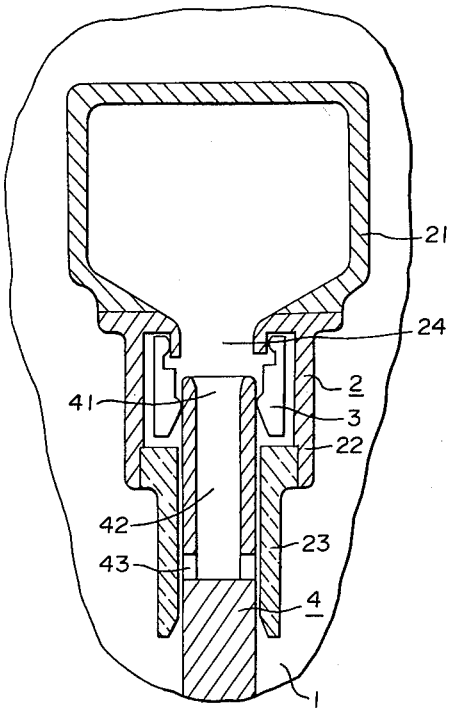
FIG. 2 is an enlarged sectional view of the important part of FIG. 1.

FIGS. 1 and 2 show the structure of the interrupter according to the present invention.

In FIGS. 1 and 2, the reference numeral (1) designates a container filled with a gas for arc extinction such as $SF_6$ gas; (2) designates an arc extinct chamber filled with the gas for extinction which is disposed in the container (1) and comprises a pressure chamber (21) made of a metal having high heat conductivity and high mechanical strength and an arc extinct chamber body (22) made of the same metal and a flow guide (23) made of an insulating material having arc resistance such as polytetrafluoroethylene (Teflon).

The reference numeral (3) designates a fixed contact mounted on the arc extinct chamber body (22); (4) designates a partially cylindrical movable contact which comprises a nozzle disposed and which is detouchable to the fixed contact (3) and a gas passage (42) and an opening part (43).

When the movable contact (4) is descended while interlocking to the operation of the operating device (not shown) to depart the contacts (3), (4), the arc is formed between the contacts. When the movable contact (4) is further descended, the arc is extended in the flow guide (23) whereby the gas for arc extinction filled in the environment is heated to give the condition of high pressure and high temperature. The inner pressure is propagated in all space of the pressure chamber (21) whereby the space becomes high pressure condition for a short time. On the other hand, the temperature is propagated at remarkably slower velocity than the velocity of the pressure propagation by the condition, the convection and the turbulence.

Accordingly, when the passage (24) from the arc space to the pressure chamber (21) is adjusted to a suitable length, the extension of the arc space is controlled to decrease the turbulence conduction which is a remarkably high heat conduction and the gas fed from the arc space to the pressure chamber (21) is contacted with the metallic wall of the gas passage (24) at low temperature to be cooled whereby the gas in the gas pressure chamber (21) is kept at the low temperature.

The arc space is not formed in the pressure chamber (21), however, the ions formed in the arc space are neutralized by the high conductive pressure chamber (21) and the arc extinct chamber body (22) whereby the arc extinct function of the high pressure gas is maintained.

On the other hand, the gas pressure is not decreased to keep the high pressure between the high pressure gas is kept in the closed space and is not discharged.

Accordingly, the gas in the pressure chamber (21) is kept in the condition of high pressure and low temperature so as to complete the condition for puffing. When the movable contact (4) is descended, the opening part (43) is connected to the container (1). At this moment, the high pressure in the pressure chamber (21) is maintained in the case of passing the arc current because the nozzle (41) is closed by the arc. Then, the arc current is decreased to release the closing condition, the pressure in the pressure chamber (21) is released to immediately result the arc extinction. The degree of the arc extinction is increased depending upon the lower temperature and higher pressure of the gas in the pressure chamber (21). The ionized gas is contacted with the metallic wall of the gas passage (24) and the pressure chamber (21) which are made of a heat conductive metal whereby the gas is deionized to improve the arc extinct function and the insulating function.

Incidentally, the temperature elevation caused by the contact resistance of the contacts (3), (4) and the heat generation and the heat conduction of the fixed contact (3) at the arc current interruption, is remarkably reduced to be capable of increasing the current capacity because of large heat capacity and large heat radiating area in the pressure chamber (21).

It is possible to use the structure of the container (1) made mainly of the insulating material as shown in the drawing, by increasing the cooling effect of the gas pressure chamber (21) to radiate heat out of the container, even though the heat generation is large during repeated interruptions.

Figure 3:
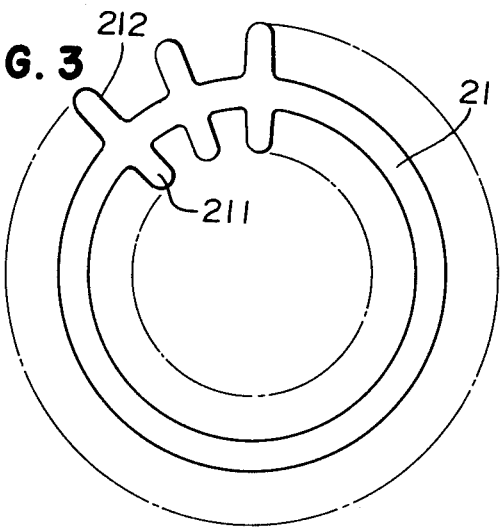
FIG. 3 is an enlarged sectional view of the other embodiment of the present invention.

The effects of heat absorption and heat radiation of the pressure chamber can be improved by increasing the gas contacting area and the heat radiating area of the pressure chamber are increased by providing an inside heat absorbing fin (211) and an outside heat radiating fin (212) as shown in FIG. 3. It is also possible to provide either the inside fin or the outside fin. When the movable contact (4) is further descended to open the opening part (43) to the container (1), the arc current is decreased and the effect for closing the pressure chamber (21) with the arc is released to puff the high pressure gas from the pressure chamber (21) whereby the arc extinction is immediately resulted. In the operation, the high pressure gas in the pressure chamber (21) is kept in low temperature whereby the arc cooling and diffusing effects are remarkably high to attain excellent arc interrupting effect.

It is possible to prevent the expansion and the spreading of the gas at high temperature caused in the arc space, whereby the arc is rapidly discharged and diffused out of the arc space in the arc extinction.

Figure 4:
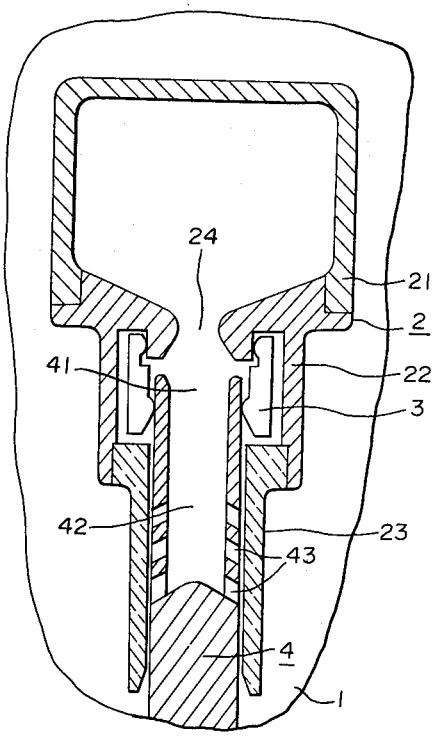
FIG. 4 is an enlarged sectional view of the other embodiment of the present invention.

FIG. 4 shows the other embodiment of the present invention.

In FIG. 4, the reference numeral (1) designates a container filled with a gas for extinction such as $SF_6$ gas; (2) designates an arc extinct chamber filled with the gas for extinction which is disposed in the container (1) and comprises a pressure chamber (21) and an arc extinct chamber body (22) which are made of an electric conductive material and a flow guide (23) made of an insulating material having arc resistance such as polytetrafluoroethylene (Teflon) which is mounted on the arc extinct chamber body (22). The reference numeral (3) designates a fixed contact mounted on the arc extinct chamber body (22); (4) designates a partially cylindrical movable contact which is detouchably disposed to the fixed contact (3) and comprises a nozzle (41), a gas passage (42) plural opening parts (43) disposed radially to the axial direction.

The sum of the area of all of the opening parts (43) is substantially the same with the sectional area of the nozzle (41). The opening parts (43) are disposed to form the closed condition by the flow guide (23) during the time contacting the contacts.

When the movable contact (4) is descended while interlocking to the operation of the operating device (not shown) to depart the contacts (3), (4), the arc is formed between the contacts.

During the time further descending the movable contact (4) until opening the lowest end of the opening parts (43) to the container (1), the pressure in the arc space is remarkably raised and the pressure in the gas pressure chamber (21) is raised because the arc space is closed except connecting through the gas passage (24) to the pressure chamber (21). After raising the pressure of the pressure chamber (21) over the pressure required for the interruption, a part of the opening parts (43) is opened to the container (1) whereby the pressure in the arc is released to prevent the raising of the pressure in the arc.

When the movable contact (4) is further descended to increase the arc energy, the other opening parts (43) are opened to cause further, the release of the pressure to the container (1) corresponding to the condition, whereby the pressure in the pressure chamber (21) maintains the substantially equilibrium condition. In such a condition, excess energy in the arc space is continuously discharged through the opening parts (43) whereby the temperature of the gas in the arc space is kept at a relatively low level. That is, the pressure in the arc space and the pressure in the pressure chamber (21) are kept in equilibrium condition at the controlled pressure and the arc voltage is also controlled, thereby providing the synergistic effect for controlling the input energy to the arc space.

When the movable contact (4) is further descended to increase the opening condition of the opening parts (43) and the pressure in the arc space is reduced depending upon the decrease of the arc current, the pressure in the pressure chamber (21) is rapidly released and the gas kept in the arc space under the controlled pressure and the temperature is puffed out of the arc space to easily replace the gas to the new gas in the gas pressure chamber (21) whereby the arc current becomes zero and the arc extinction is performed without failure.

The embodiment has the structure for controlling the pressure and the temperature of the gas in the arc space.

Accordingly, from the viewpoint of the pressure, the flow guide (23) can be prepared by molding Teflon etc. without using a material having high mechanical strength which is advantageous in the practical structure.

From the viewpoint of the temperature, the heat deterioration of the material adjacent to the arc space is decreased and a material having a lower melting point such as aluminum can be used and the consumption of the contact can be decreased, which is advantageous in the practical structure.

The structure can be applied for the puffer type interrupter and the other fluid interrupter such as the oil interrupter.

In FIG. 4, the sectional area of the passage is selected to be narrower than that of the other part whereby the flow rate of the fluid for arc extinction can be further controlled. Thus, the fluid at high temperature fed from the arc space to the pressure chamber (21) is adiabatically diffused by the passage (24). Accordingly, the temperature of the fluid for arc extinction is lowered. As the result, the fluid for arc extinction reaches to the pressure required for arc extinction after a suitable time without raising the temperature of the fluid so high. When the outlet (42) is opened, the high pressure fluid for arc extinction at lower temperature is passed through the passage (24) whereby the adiabatically thermal expansion is resulted to diffuse it whereby the fluid for arc extinction is discharged under cooling the ionized fluid at high temperature in the arc space.

Figure 5:
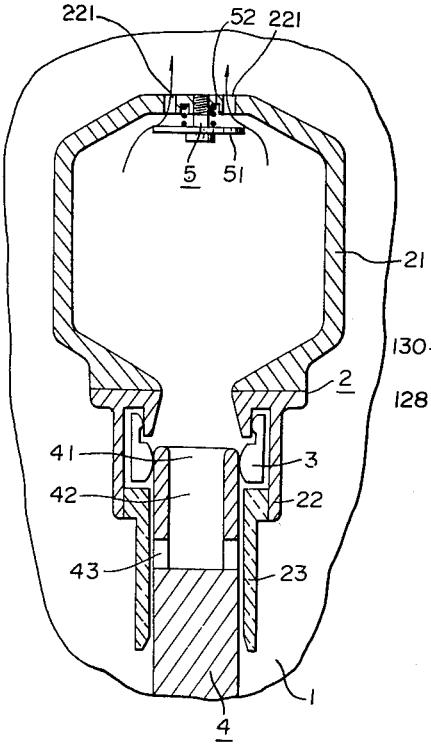
FIG. 5 is an enlarged sectional view of the other embodiment of the present invention.

FIG. 5 shows the other embodiment of the present invention.

In FIG. 5, the reference numeral (1) designates a container filled with a gas for extinction such as $SF_6$ gas; (2) designates an arc extinct chamber filled with the gas for extinction which is disposed in the container (1) and comprises a pressure chamber (21) made of a metal and having an upper slant surface and an arc extinct chamber body made of a conductive material and a flow guide made of an insulating material having arc resistance. The reference numeral (3) designates a fixed contact mounted in the arc extinct chamber body (22); (4) designates a movable contact which comprises a nozzle (41), a gas passage (42), and an opening part (43) and which is detouchable to the fixed contact (3); (5) designates a pressure valve which comprises a valve body (51) and a spring (52) which is disposed at the opening parts (221) of the top of the upper slant surface of the pressure chamber (21) and which is opened in normal state and is closed when the pressure in the pressure chamber raised higher than a specific value.

When the movable contact (4) is descended under interlocking to the operation of the operating device (not shown) to move for suitable wiping distance, the contacts (3), (4) are departed to form the arc between the contacts. The pressure in the pressure chamber (21) is raised by the gas pressure raising function of the arc in the arc space. However, the pressure valve (5) is actuated by slightly raising the pressure to close the pressure chamber (21) whereby the pressure in the pressure chamber (21) is rapidly raised.

When the movable contact (4) is further descended to open the opening part (43) and the arc current decreases near zero to eliminate the arc closing function, the high pressure gas in the gas pressure chamber (21) is opened and the arc space is cooled and the gas is puffed to immediately perform the arc extinction. After the arc extinction, the high pressure gas remained in the pressure chamber (21) is discharged for a short time through the opening (43) under the full opening condition.

Then, the gas in the pressure chamber (21) at the temperature higher than the temperature in the container (1), is discharged through the opening parts (221) to the container (1) under opening the opening parts (221) depending upon the reduction of the pressure. Thus, the gas at lower temperature in the container (1) is fed in through the opening part (43) to replace the gas in the pressure chamber (21). The interrupter is returned to the condition before the operation. Accordingly, in the case of repeating the interrupting operation, the substantially same characteristic with that of the first operation can be attained.

Figure 6:
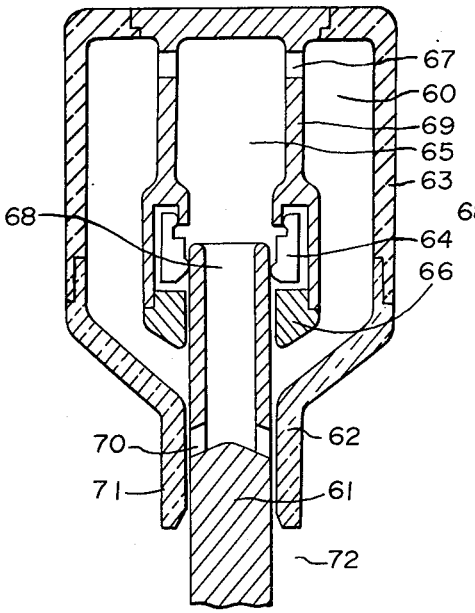
FIG. 6 is an enlarged sectional view of the other embodiment of the present invention.

FIG. 6 shows the other embodiment of the present invention.

As shown in FIG. 6, a pressure chamber (60) which is filled with the gas for arc extinction ($SF_6$ gas) and has the main function for arc extinction in the operation is provided. The pressure chamber for arc extinction (60) comprises a shell (62) surrounding a movable contact (61) made of an insulating material such as Teflon to form a flow guide, at the lower end. The reference numeral (63) designates a shell which forms the pressure chamber for arc extinction. A fixed contact (64) which is detouchable to the movable contact (61) is formed under surrounding by the pressure chamber for arc extinction (60) and is formed in one body with a pressure chamber (65) in which the gas pressure is raised by the arc and the high pressure gas is fed to the chamber (60).

The fixed contact (64) is disposed at the lower end of the pressure chamber (65) and is surrounded for increasing the high pressure effect in the pressure chamber (65) and the shell (66) is made of the same material with that of the shell (62) and the pressure chamber (65) is substantially closed except for passages (67) so as to reach enough pressure for the arc extinction in the chamber (60) until the movable contact (61) is passed through the shell (66).

The contacts (61), (64) are departed to form the arc between them and the pressure in the chamber (60) is raised by the gas fed through the pressure chamber (65) under the effect for raising the pressure by the arc. The arc current is periodically varied until forming the minimum distance between the contacts (61), (64) required for the arc extinction by expanding the arc while descending the movable contact (61), whereby it forms the opening part (68) for maintaining the pressure of the high pressure gas in the chamber (60) by the closing function of the arc even though the arc current includes zero value.

The feed of the gas from the pressure chamber (65) to the chamber (60) continues during the time expanding the arc generated between the contacts (61), (64), in the pressure chamber (65). The time is decided by varying the relative velocity between the movable contact (61) and the shell (69) as the part of the pressure chamber (65). For example, in order to prolong the operation time to raise the pressure in the chamber (60), the object can be attained by providing longer time for lower direction and shorter time for upper direction at the constant velocity of the movable contact.

During the operation time, the pressure chamber (65) has suitable volume for providing high pressure in the chamber (60) and is disposed near the arc space or to form the arc space in one space with the capacity space whereby the pressure in the pressure chamber (65) is effectively raised.

The pressure chamber (65) is preferably to be a smaller volume in comparison with that of the chamber (60). Accordingly, the uniform pressure and temperature are easily given in the pressure chamber (65) whereby the feed of the gas to the chamber (60) is smoothly performed in the normal state and the pressure raising in the chamber (60) is rapidly performed at lower temperature to give high pressure source in the optimum condition. This is closed in the normal state and the pressure in the chamber (60) is raised to open the opening part whereby the gas is puffed through the arc space.

The gas outlet (70) formed in the movable contact (61) can be opened to release the high pressure gas at higher temperature in the pressure chamber (65) before releasing the high pressure gas at lower temperature in the chamber (60) by selecting the relative relation of the lower cylindrical part (71) of the shell (62), the end opening part (68) of the movable contact (61) and the shell (66).

The time required for raising the pressure in the pressure chamber (65) by the arc is remarkably longer than the time for releasing the high pressure gas in the chamber (60), and accordingly, the counter-flow from the chamber (60) to the pressure chamber (65) can be practically prevented by providing suitable size and numbers of the passage (67). Sometimes, the pressure raising and maintenance in the chamber (60) can be easy to provide stable characteristic by disposing a check valve.

The operation of the embodiment will be illustrated.

When the movable contact (61) is descended while interlocking to the operation of the operating device (not shown) the movable contact (61) moves for suitable wiping distance from the fixed contact (64) to form the arc between them. The gas in the pressure chamber (65) is rapidly heated and expanded by the arc to result the pressure raising function, whereby the pressure of the gas in the pressure chamber (65) is raised to result the pressure different to the pressure in the chamber (60) whereby the gas is fed through the passage (67) into the chamber (60).

The operation is continued until further descending the movable contact (61) to pass the opening part (68) through the shell (66) and to connect it to the opening part (71) for the arc space in the chamber (60). During the period, the pressure of the gas in the chamber (60) is raised to enough pressure required for the arc extinction.

The period relates directly to the feed of the gas to the chamber (60). That is, it decides the pressure raising characteristic. Accordingly, suitable period is selected depending upon the volume of the pressure chamber (65) and the descending operation of the movable contact (61). For example, when the volume in the pressure chamber (65) is too large in comparison with the arc energy or the gas in the pressure chamber (65) is not effectively heated and expanded by the arc energy, it is difficult to rapidly feed the gas into the chamber (60) to increase the pressure.

In order to improve the effect, it is effective to combine the operation that turbulence of the gas is caused in the pressure chamber (65) to provide high velocity of the heat diffusion in equivalent for the slow heat propagation or the high pressure gas at higher temperature near the arc is flowed as the jet flow to increase the diffusion velocity or the arc is expanded deeply into the pressure chamber (65) by the magnetic characteristic of the arc to increase the heating effect.

When the gas outlet (70) is opened to the adjacent chamber (72) and the arc current is decreased at the end of the operation, the high pressure gas at lower temperature in the chamber (60) is puffed to the arc space depending upon releasing the closing of the opening part (68) by the arc to cool the arc space and the ionized gas is diffused and discharged for short time to immediately perform the arc extinction.

Even though the circuit condition is severe to continue the arc after passing the movable contact (61) through the shell (66), the gas in the chamber (60) is not discharged near the peak of AC current and the pressure in the chamber (60) is recovered by feeding the gas from the arc space though the gas is slightly discharged during the time decreasing the arc current to a small value whereby the stable arc extinct characteristic is attained because the actuating point for closing the opening part (68) is selected as desired.

Even though more than one zero value of the arc current is given under the severe circuit condition for long arcing time, the high pressure gas in the chamber (60) is maintained (continuously during the time passing the arc current) whereby the volume of the chamber (60) can be minimized in suitable feature and the interrupter can be minimized in the economical structure.

The volume of the chamber (60) is minimized in suitable feature, whereby the pressure chamber (65) for the pressure increase in the chamber (60) can be also minimized. Accordingly, the interrupter can be miniaturized. The miniaturization of the chamber (65) imparts high pressure raising effect by small arc energy, whereby the stable arc extinct characteristic can be attained, in wide range from large current to small current.

Figure 7:
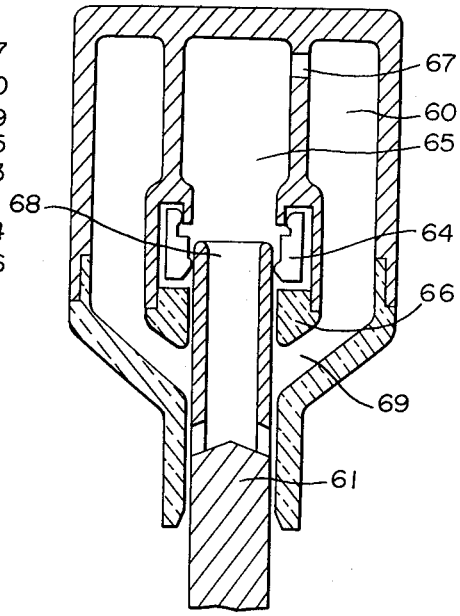
FIG. 7 is an enlarged sectional view of the other embodiment of the present invention.

FIG. 7 shows the other embodiment of the present invention.

A chamber for arc extinction (60) filled with the gas for arc extinction which has the main function to perform the arc extinction in the operation, is provided. The chamber (60) is a feed source for the gas for arc extinction used for the arc extinction, and has suitable volume for the arc extinction and has a substantially cylindrical shape and a passage at the lower end which is connected to the arc space.

The opening part is closed by the movable contact (61) in the normal state and a cylindrical pressure chamber (65) which is coaxially surrounded by the chamber (60). When the pressure of the gas is increased by the arc in the chamber (65) to feed the gas through the passage (67) to the chamber (60), the pressure raising effect in the chamber (60) is effectively attained.

The ring shaped fixed contact (64) which is detouchable from the movable contact (61) is disposed at the lower end of the chamber (65) and is contacted with the outer wall of the movable contact (61). The fixed contact (64) is disposed to the chamber (65) and the part (66) at the lower end to form the nozzle having the shape effective for the arc extinction.

The high pressure resistance is required for the chamber (65) because the high pressure is given during the closing time for pressure raising operation. Accordingly, it is preferable to have the cylindrical shape. When the chamber (65) is disposed in the chamber (60), the pressure difference to the pressure in the chamber (60) can be reduced whereby the structure of the container can be simple.

When the releasing pressure in the pressure releasing valve is set at suitable level, the pressure releasing valve is actuated in excess of the pressure raising effect by large arc current, whereby the opening is formed with the opening part (68) of the movable contact (61) and the excess pressure is controlled and the arc extinct effect resulted by the two way pressure releasing is increased. When the arc current is small, the opening is reduced to effectively release the pressure in the chamber (60) whereby the arc extinction is effectively attained.

Figure 8:
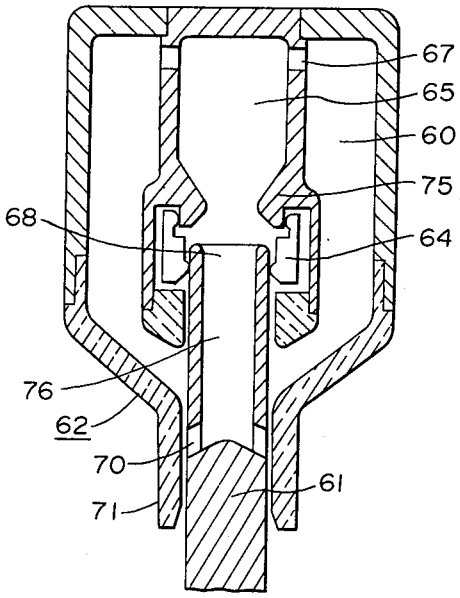
FIG. 8 is an enlarged sectional view of the other embodiment of the present invention.
Figure 9:
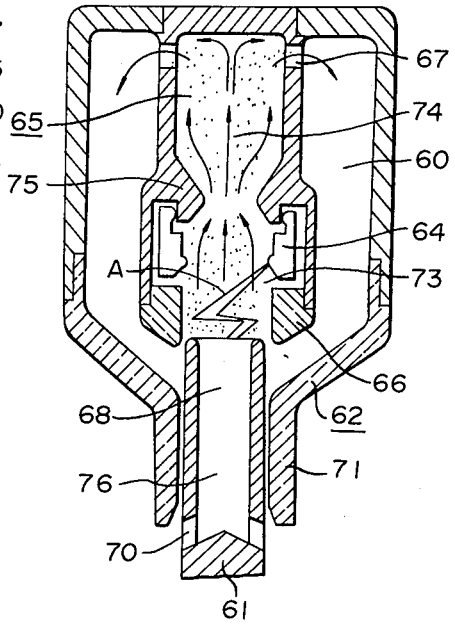
FIG. 9 is an enlarged sectional view of the other embodiment of the present invention.

FIGS. 8 and 9 show the other embodiments of the present invention.

As shown in the drawings, it comprises the chamber for arc extinction (60) which is filled with the gas for arc extinction such as $SF_6$ gas as the source of the high pressure gas for arc extinction in the operation and the pressure chamber (65) in which the pressure of the gas for arc extinction is raised by the arc formed between the fixed contact (64) and the movable contact (61) which is detouchable to the fixed contact (64) and the high pressure gas is fed to the chamber (60).

The pressure chamber (65) comprises a chamber (73) as the lower arc space and the chamber (74) which effectively results the pressure raising in the chamber (60). The chambers (73), (74) are substantially partitioned by the fixed contact (64). A diffusion hole (75) for diffusing the hot gas fed into the chamber (74) from the arc space is disposed at the partitioning part whereby the heating and expanding (pressure raising) effect in the chamber (74) is accelerated and the pressure of the gas in the chamber (60) is rapidly raised to give the high pressure for a short time.

In this embodiment, the pressure in the chamber (60) can be raised to the required level even though the arc current is small and the arc energy is small whereby the deterioration in the small arc current is prevented. The structure of the diffusion hole (75) can be the system for forming jet flow as the single or plural nozzle or the system disposing a deflection plate for turbulent diffusion. At the end of the movable contact (61), the opening part (68), the gas discharging passage (76) and the gas outlet (70) are formed and the time for opening the opening part (68) is set depending upon the relation of the cylindrical part (71) of the shell (62) at the lower end of the chamber (60) and the pressure raising in the chamber (60) is given through the chambers (73), (74) and the opening is effectively opened to perform the arc extinction.

The operation of the embodiment will be illustrated.

When the movable contact (61) is descended while interlocking to the operation of the operating device (not shown), the movable contact (61) moves for suitable wiping distance for the fixed contact (64) to form the arc A between them. (FIG. 9) The gas in the arc space is rapidly heated and expanded by the arc to result the high pressure gas at high temperature. The resulting high pressure gas is puffed as jet flow through the diffusion hole (75) into the chamber (74) as shown by the arrow line in FIG. 9 whereby the uniform high temperature and high pressure gas is formed in the chamber (74).

That is, the hot gas having slow propagation velocity in the arc space is propagated with the faster flow resulted by the pressure difference whereby the pressure of the gas is rapidly raised by the pressure raising effect and the gas is passed through the passages (67) to give the suitable pressure in the chamber (60) for a short time.

The pressure required for arc extinction can be given even though the arc current is small.

When the movable contact (61) is further descended to open the opening part (68) to the chamber (60), and the pressure in the arc space is suddenly reduced because of periodical decreasing of the arc current, whereby the high pressure gas in the chamber (60) is puffed to the arc space and the gas is highly diffused to cool the arc space whereby the arc extinction is rapidly performed.

Figure 10:
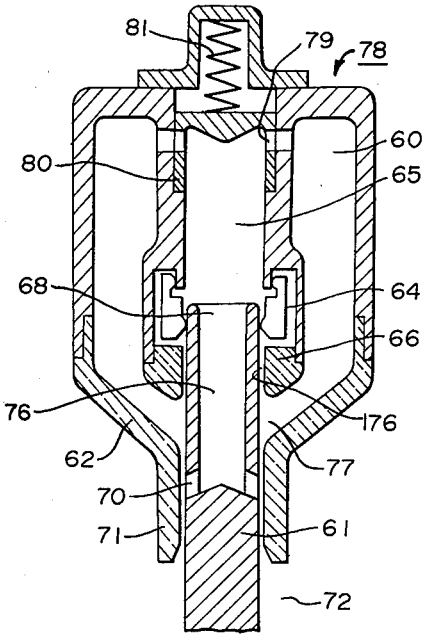
FIG. 10 is an enlarged sectional view of the other embodiment of the present invention.

FIG. 10 shows the other embodiment of the present invention.

A valve which is actuated by the pressure given by the pressure raising effect of the chamber 65 to the chamber 60 or a pressure releasing valve for discharging the gas in the chamber 65 in excess of the pressure in the chamber 65 is disposed at the upper end of the chamber 65 to prevent excess pressure raising in the chamber 60 and to impart the diffusion effect of the high pressure gas in the chamber 60 by discharging the ionized gas in the arc space from the upper and lower openings as shown in FIG. 10.

As shown in the drawing, it comprises the chamber for arc extinction (60) which is filled with the gas for arc extinction such as $SF_6$ gas as the source of the high pressure gas for arc extinction in the operation and the pressure chamber (65) in which the pressure of the gas for arc extinction is raised by the arc formed between the fixed contact (64) and the movable contact (61) which is detouchable to the fixed contact (64) and the high pressure gas is fed to the chamber (60).

The chambers (60) and (65) are coaxially disposed and the movable contact (61) is fitted and the opening part (77) is formed at the arc space formed by moving the movable contact (61). In order to increase the pressure raising effect to maintain suitable functional time by the arc formed between the contacts (64), (61) which are disposed in the chamber (65), a shell (66) made of an insulating material which surrounds the movable contact (61) is connected to the pressure chamber (65) in one body at the lower end.

The movable contact (61) comprises the nozzle opening (68), the gas discharge passage (76) and the outlet (70) at the end. Excess pressure in the pressure chamber (65) can be released and the timing of the puffing of the high pressure gas in the chamber (60) can be selected as desired depending upon the relation of the positions of the shell (62) made of the insulating material at the lower end of the chamber (60) the cylindrical part (71) surrounding the movable contact (61) in the shell (62) and the outlet (70).

The valve (78) is disposed between the chambers (60), (65) and the valve (78) has the function for passing the gas from the pressure chamber (65) to the chamber (60) until raising the pressure in the pressure chamber (65) to suitable level and stopping the gas flow at over level of the pressure.

When the pressure in the pressure chamber (65) is raised by the pressure raising effect by the arc and the high pressure gas is fed to the chamber (60) and the high pressure gas in the pressure chamber (65) is discharged after raising the pressure in the chamber (60) to suitable level, prior to the puffing the high pressure gas in the chamber (60), excess pressure in the chamber (60) can be controlled and the gas puffing effect of the chamber (60) can be improved.

When the pressure of the gas in the chamber (60) is raised over the level required for arc extinction, the arc voltage is raised and the arc energy is increased and excess pressure is given. At the same time, the chamber is heated at high temperature, whereby severe pressure and temperature condition is given for the substrates of the chambers the consumption and damage of the contacts are caused to remarkably decrease the practical function.

The operation of the embodiment will be illustrated.

When the movable contact (61) is descended while interlocking to the operation of the operating device (not shown), the movable contact (61) moves for suitable wiping distance for the fixed contact (64) to form the arc between them. The gas in the arc space is rapidly heated and expanded by the arc to raise the pressure and the gas is fed through the passage (79) to the chamber (60).

The movable contact (61) is further descended to expand the arc and the arc voltage is raised and the arc energy is rapidly increased to raise the pressure in the chamber (65). At the step, the high pressure gas is fed from the pressure chamber (65) to the chamber (60) until raising the pressure to suitable pressure required for the arc extinction in the chamber (60). When the pressure raises over the level the valve body (80) of the valve (78) is pushed up against the predetermined force of the spring (81) to close the passage (79), whereby the pressure raising in the chamber (60) is stopped.

When the movable contact (61) is descended to connect the outlet (70) to the adjacent chamber (72), the high pressure gas is discharged through the nozzle (68) depending upon the decrease of the arc current and the nozzle (68) is connected to the opening part (77) and the high pressure gas having the pressure enough to the arc extinction in the chamber (60) is puffed to rapidly cool and diffuse the arc space to perform the arc extinction.

Figure 11:
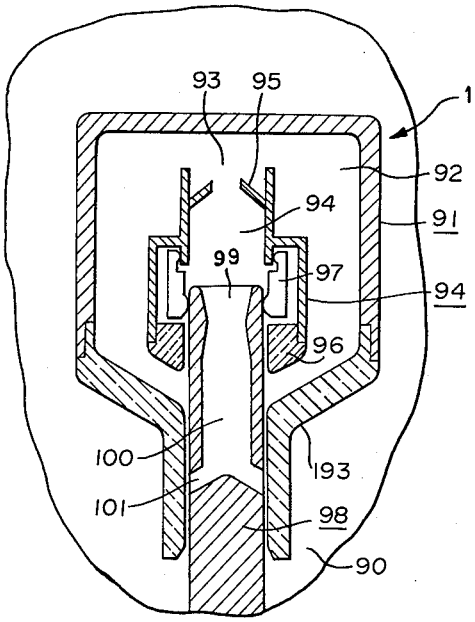
FIG. 11 is an enlarged sectional view of the other embodiment of the present invention.
Figure 12:
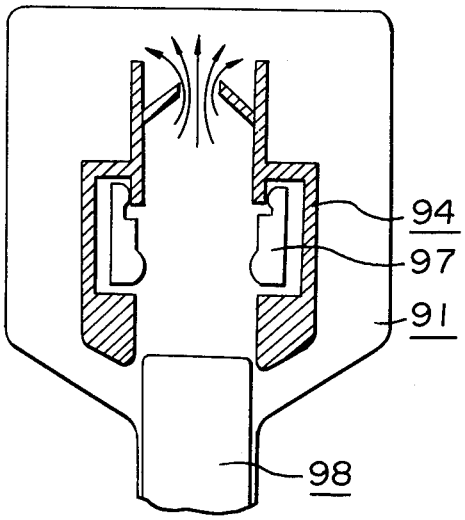
FIGS. 12 and 13 are respectively schematic views for illustrating the function of the circuit interrupter of FIG. 11.
Figure 13:
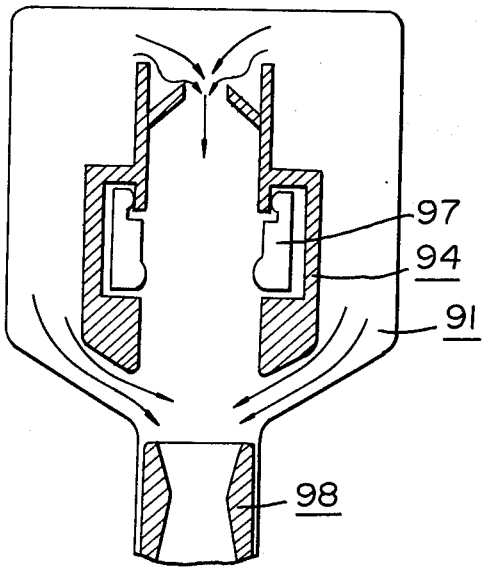

FIGS. 11 to 13 show the other embodiments of the present invention.

In the drawings, the reference numeral (90) designates the container filled with the gas for arc extinction; (1) designates the first arc extinct chamber comprising the pressure chamber (92) disposed in the container and the shell (193) made of an insulating material mounted on the pressure chamber and the gas passages (93); (94) designates the second arc extinct chamber comprising the pressure chamber (94) and a circular cone shape counter-flow controlling plate (95) mounted on the chamber and a shell (96) made of an insulating material mounted on the pressure chamber (94); (97) designates a fixed contact disposed in the second arc extinct chamber (94); (98) designates a movable contact comprising a gas inlet (99), a passage (100) and the outlet (101) which is disposed to be detouchable to the fixed contact (97).

The gas is heated and expanded by the arc formed by departing the contacts (97), (98) to result high pressure gas in the pressure chamber (94) and to feed the high pressure gas through the passage (93) to the passage chamber (92) in the first arc extinct chamber (91).

When the gas is fed from the pressure chamber (94) to the pressure chamber (92) by the counter-flow controlling plate (95), the flow resistance is low, whereas in the opposite flow, the flow resistance is remarkably high. The gas fed into the arc space is mainly the high pressure gas at low temperature formed at the lower part of the pressure chamber (92).

The pressure raising time for substantially passing the movable contact (98) through the shell (96), is relatively long, whereby the effect of the counter-flow controlling plate (95) is further improved by decreasing the sectional area of the gas passage (93). The practical effect is substantially equal to that of the mechanical check valve.

The gas passed through the passage (93) is at high temperature under high pressure and accordingly, the mechanical valve is difficult to maintain in stable operation under the environmental condition, and the complicated structure of the valve is needed to be large and expensive. However, as shown in the drawing, the counter-flow controlling plate (95) and the gas passage (93) are disposed in suitable shapes, whereby the stable opening and closing function can be given without any moving part in the simple and economical structure to impart the accurate function.

The operation of the embodiment will be illustrated.

When the movable contact (98) is descended while interlocking to the operation of the operating device (not shown), the movable contact (98) moves for suitable wiping distance for the fixed contact (97) to form the arc between them by departing the contacts (97), (98) as shown in FIG. 12. The arc is expanded in the shell (96) depending upon the descending operation of the movable contact (98) to raise the pressure of the gas in the pressure chamber (94). The high pressure gas is smoothly fed through the passage (93) into the pressure chamber (92). The operation is continued until further descending the movable contact to pass through the shell (193) and the arc extinct chamber (91) is in the substantially closed condition to effectively and smoothly raise the pressure in the pressure chamber (92). Thus, the pressure of the gas in the chamber (91) is raised to suitable level and the high pressure gas at lower temperature is kept in the lower part of the pressure chamber (92).

When the movable contact (98) is further descended to connect the opening (99) to the gas passage (94), the high pressure gas in the chamber (91) is discharged into the container (90). In the step of periodically varying the arc current to decrease to zero, the diameter of the arc is suddenly decreased depending upon the decreasing the arc current, and the closing condition of the opening (99) is released at the same time, whereby the high pressure gas in the pressure chamber (92) is mainly puffed to the arc space formed by the shell (193) as shown by the arrow line to cool the arc space and to diffuse the ionized gas.

In the operation, the counter-flow to the pressure chamber (94) is substantially prevented by the counter-flow controlling plate (95).

When the arc current is further decreased to zero, the arc space is cooled and diffused by the high cooling and diffusing effect of the high pressure gas at lower temperature in the first arc extinct chamber (91) to perform the arc extinction and the insulating function between the contacts are rapidly recovered. Accordingly, the interrupter having short arcing time and high efficiency which have large capacity and high voltage can be obtained.

Figure 14:
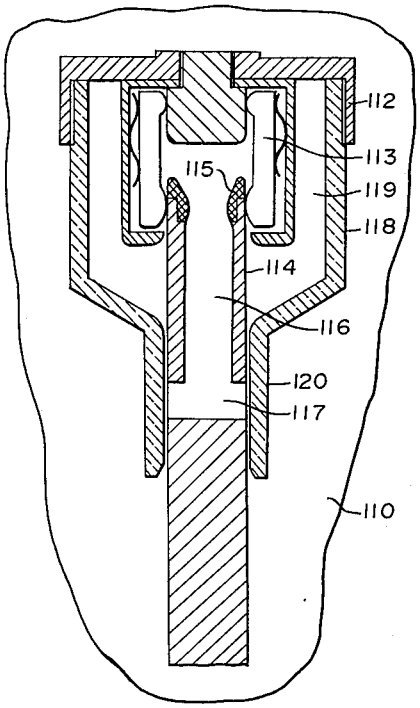
FIG. 14 is an enlarged sectional view of the other embodiment of the present invention.

FIG. 14 shows the other embodiment of the present invention.

In FIG. 14, the reference numeral (110) designates a container filled with the gas for arc extinction such as $SF_6$ gas; (112) designates an upper cover mounted on a conductive part (not shown); (113) designates a fixed contact made of a conductive material which is mounted at the lower surface of the upper cover (112); (114) designates a hollow-cylindrical movable contact made of a conductive material which comprises a nozzle (115) at the end and a gas discharging passage (116) and a gas outlets disposed in radial directions and which is disposed to be detouchable to the fixed contact (113); (118) designates an arc extinct chamber made of an insulating material which comprises an arc extinct chamber body (119) which is mounted on the upper cover (112) and is filled with the gas for arc extinction and contains the fixed contact (113) and the arc extinct chamber also comprises a flow guide (120) which guides the gas flow and is disposed at lower part and which closes the gas outlet (117) of the movable contact (114) under the condition contacting the contacts.

The position for connecting the gas outlet (117) to the container (110) by descending the movable contact (114) is substantially the same with the minimum interrupting distance and suitable gap is maintained from the movable contact (114) to the lower end of the flow guide (119) under the condition completely departing the contacts.

The operation of the embodiment will be illustrated.

When the movable contact (114) is descended while interlocking to the operation of the operating device (not shown), and the contacts (113), (114) are departed after suitable wiping operation, the arc is formed between the contacts. In this case, the arc extinct chamber (118) is closed until departing the contacts (113), (114) for the minimum interrupting distance required for interrupting at the initial stage whereby the gas for arc extinction in the arc extinct chamber body (119) is heated, expanded or decomposed by the arc and the pressure is raised to suitable level required for the arc extinction.

When the movable contact is further descended to pass the gas outlet (117) to the lower end of the flow guide (120) and the gas outlet (117) is connected to the container (110), the high pressure gas having the pressure level for the arc extinction is discharged from the arc extinct chamber body (119) through the nozzle (115), the gas passage (116) and the gas outlet (117). Accordingly, the arc extinction of the arc formed between the contacts (113), (114) is rapidly performed by the puffing effect given by the puffing through the nozzle (115) and by the distance between the contacts.

The position of the upper end of the flow guide (120) is substantially the same with the position of the upper end of the movable contact (114) when the movable contact (114) reaches to the minimum interrupting distance to the fixed contact (113). Accordingly, the optimum condition of the nozzle (115) to the arc extinct chamber (118) is not substantially varied in the further descending operation of the movable contact (114) regardless of the position of the movable contact (114) whereby the interrupting function of the interrupter is excellent and stable.

Figure 15:
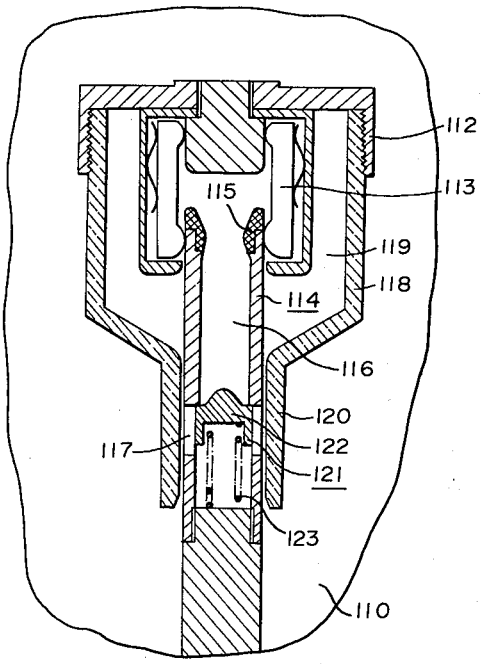
FIG. 15 is an enlarged sectional view of the other embodiment of the present invention.

FIG. 15 shows the other embodiments of the present invention.

In FIG. 15, the reference numeral (110) designates the container filled with the gas for arc extinction; (112) designates the upper cover mounted on the conductive substrate (not shown); (113) designates the fixed contact made of a conductive material mounted on the lower surface of the upper cover (112); (114) designates a hollow-cylindrical movable contact made of a conductor material which comprises the nozzle (115) formed at the end and the gas passage (116) and gas outlets 117 disposed in radial directions and which is disposed to be detouchable to the fixed contact and which is mounted on the rod for operation (not shown); (121) designates a pressure control valve which is disposed in the gas passage of the movable contact (114) which connects the gas passage (116) to the gas outlet (117) when the pressure in the gas passage raises higher than the specific level and which comprises the valve body (122) and the spring (123).

The pressure control valve (121) has the function for varying the area of the opening of the gas outlet depending upon the pressure in the gas passage (116). When the pressure raising is relatively low in the gas passage, the area of the opening is relatively small whereas when the pressure is high; the arc of the opening is large to attain the puffing effect of the gas to the arc. The reference numeral (118) designates the arc extinct chamber which comprises the arc extinct chamber body mounted on the upper cover (112) and which is made of the arc resistant material such as Teflon to give the pressure required for the interrupting and which is filled with the gas for arc extinction such as $SF_6$ gas and which contains both of the contacts (113), (114) and the arc extinct chamber also comprises the flow guide (120) which has a communicating hole having the substantially same with the diameter of the movable contact (114) to receive the movable contact (114) and which effectively guides the gas flow in the descending operation to descend the nozzle (115) over the position for the minimum interrupting distance.

The movable contact (114) has suitable gap from the lower end of the guide (120) when the contacts are completely departed, whereby the insulation intensity after interruption can be maintained enough high level.

The operation of the embodiment will be illustrated.

When the movable contact (114) is descended under interlocking to the operation of the operating device (not shown), and the contacts (113), (114) are departed after suitable wiping operation, the arc is formed between the contacts.

When the interrupting current is large and the gas in the arc extinct chamber body (119) is heated, expanded or decomposed by the arc at high temperature to rapidly raise the pressure, the gas outlet (117) is passed through the lower end of the guide (120) in the minimum interrupting distance and the pressure required for the interruption is actuated to the pressure control valve (121) and the valve body (122) is pushed down against the spring (123) whereby the high pressure gas in the arc extinct chamber (118) is discharged through the nozzle (115), the gas passage (116) and the gas outlet of the movable contact (114) into the container (110).

Accordingly, the arc is passed through the nozzle (115) and the interruption is completed at the time of the first zero value of the arc current after departing the minimum distance for withstanding to the restriking-voltage in the interruption. On ther other hand, when the interrupting current is small and the pressure in the arc extinct chamber (118) is not raised to the level required for the interruption after passing the minimum interrupting distance, the pressure control valve (121) is not actuated.

When the movable contact (114) is further descended to expand the arc and to raise the pressure in the arc extinct chamber (118), the pressure required for the interruption is given to actuate the pressure control valve (121) whereby the interruption is immediately attained.

Figure 16:
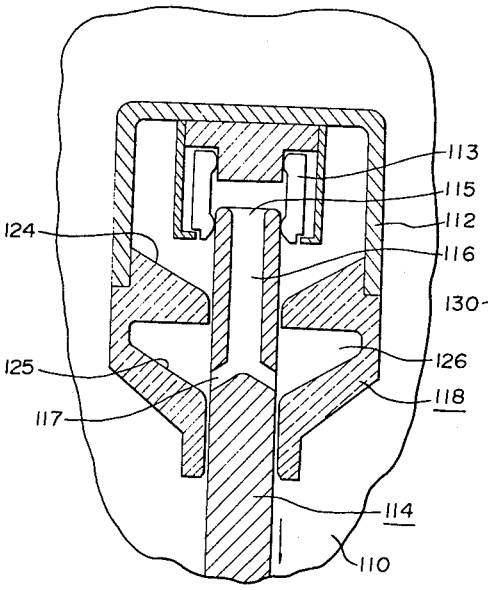
FIG. 16 is an enlarged sectional view of the other embodiment of the present invention.

FIG. 16 shows the other embodiment of the present invention.

In FIG. 16, the reference numeral (110) designates a container filled with the gas for arc extinction; (112) designates the arc extinct chamber which is filled with the gas for arc extinction and is disposed in the container (110); (113) designates the fixed contact disposed in the arc extinct chamber (112); (114) designates the movable contact which comprises the opening for the gas passage (115), the gas passage (116) and the gas outlet (117) which is disposed to be detouchable to the fixed contact (113); (118) designates a shell made of an insulating material which is mounted on the arc extinct chamber (112) to surround the movable contact (114) and comprises a circular cone shape surfaces (124), (125) for discharging the gas for guidance in an auxiliary chamber (126). The arc extinct chamber and the shell can be formed in one body.

The operation of the embodiment will be illustrated.

When the movable contact (114) is moved to the arrow line direction while interlocking to the operation of the operating device (not shown), the movable contact (114) moves for suitable wiping distance for the fixed contact (113) and the contacts (113), (114) are departed to form the arc between them.

The arc is expanded depending upon the movement of the movable contact (114), the arc irregularly moves by the self-arcing function between the contacts. On the other hand, the gas for arc extinction is heated and expanded by the arc, and the high pressure gas under turbulent condition is formed in the arc extinct chamber (112) and the auxiliary chamber (126) under the irregular movement of the arc.

When the movable contact (114) is further moved to connect the gas outlet (117) to the container (110) and the arc current is decreased, the high pressure gas in the arc extinct chamber (112) and the auxiliary chamber (126) is discharged through the opening (115), the gas passage (116) and the gas outlet (117) into the container (110).

In this case, the high pressure gas in the arc extinct chamber (112) is flowed to the opening (115) under the sudden pressure drop around the opening (115) and the high pressure gas is flowed along the smooth flow line formed by the circular cone shape surface of the shell (118), to give the non-turbulent diffusion gas whereby the diffusion efficiency is high and the flow efficiency is increased.

Accordingly, it is unnecessary to raise the pressure of the high pressure gas to higher level whereby the mechanical strength of the arc extinction chamber (112) and the shell (118) can be lowered and at the same time, the temperature of the high pressure gas can be controlled and the efficiency can be improved and the interrupter can be miniaturized and can have economical structure.

When the radial control wall is formed on the circular cone shape surface of the shell (118), the turbulent flow of the high pressure gas can be eliminated at the inlet part and the effect can be further increased.

Figure 17:
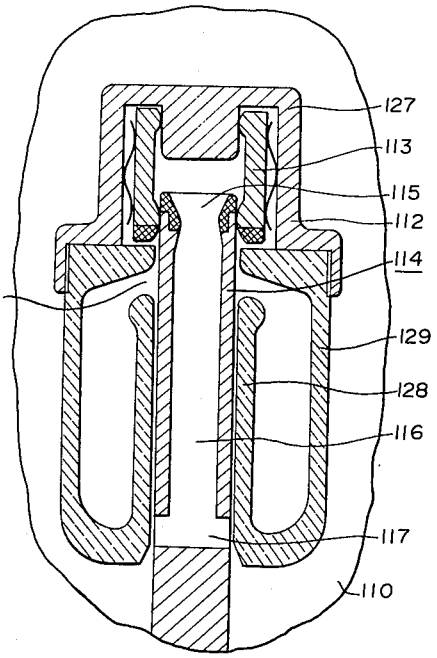
FIG. 17 is an enlarged sectional view of the other embodiment of the present invention.

FIG. 17 shows the other embodiment of the present invention.

In FIG. 17, the reference numeral (110) designates the container filled with the gas for arc extinction such as $SF_6$ gas; (112) designates the arc extinct chamber which is disposed in the container (110) and comprises the arc extinct chamber body (127) made of the conductive material and the shell (129) having the cylindrical part (128) made of an insulating material having high arc resistance such as Teflon which is mounted on the body. The reference numeral (113) designates the fixed contact disposed in the arc extinct chamber body (127); and (114) designates the movable contact which comprises the nozzle (115), the gas passage (116) and the gas outlet (117) and which is disposed to be detouchable to the fixed contact (113).

The operation of the embodiment will be illustrated.

When the movable contact (114) is descended under interlocking to the operation of the operating device (not shown), and the contacts (113), (114) are departed after suitable wiping operation, the arc is formed between the contacts. The gas for arc extinction around the arc is heated and decomposed by the arc to form the arc space at high temperature under high pressure.

The high pressure is propagated in the arc extinct chamber (112) especially in the shell (129) for short time and the pressure in the arc extinct chamber (112) is raised to the level required for the interruption.

On the other hand, the temperature is gradually raised in the arc extinct chamber (112) because of the diffusion in turbulent flow and heat conduction. The temperature in the shell (129) is controlled by the cylindrical part (128). Moreover, even though the movable contact (114) is further descended to expand the arc space in the axial direction, the area of the opening of the upper opening part (130) of the cylindrical part (128) is not increased. Moreover, the heat conduction in radial directions is blocked by the cylindrical part (128) whereby the temperature rising in the shell (129) is slow.

When the movable contact (114) is further descended to depart the contacts (113), (114) over the minimum interrupting distance, the arc space is connected to the container (110) and the arc pressure is rapidly reduced depending upon decreasing the arc current to zero. At the same time, the high pressure gas at lower temperature in the shell (129) is discharged through the opening (130) whereby the arc extinction is immediately performed.

Figure 18:
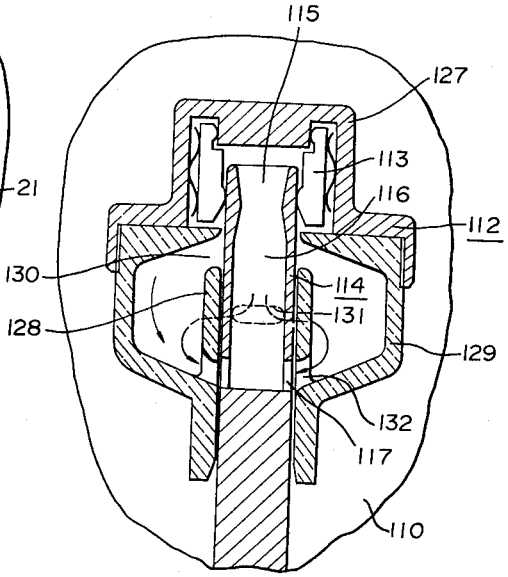
FIG. 18 is an enlarged sectional view of the other embodiment of the present invention.

FIG. 18 shows the other embodiments and have the same structure with that of FIG. 17 except providing the different opening parts (131), (132) in the shell (129) and the arc extinction is performed by the gas flow shown by the arrow line.

What is claimed as new and desired to be secured by Letters Patent of the United States is:

1. A puffer type circuit interrupter comprising:
a chamber containing an arc extinguishing fluid;
a fixed contact in said chamber;
a movable contact in said chamber, said movable contact adapted to contact said fixed contact and to be movable away from said fixed contact in a first direction whereby an arc is formed;
means for moving said movable contact;
an arc space formed between said contacts when said movable contact is not contacting said fixed contact;
a constant volume pressure chamber connected to said arc space;
a fluid discharge passage in said movable contact, said fluid discharge passage being closed until said movable contact has moved a predetermined distance in said first direction, said fluid discharge passage having a partial hollow including an outlet to said chamber and including a pressure control valve in said discharge passage, said pressure control valve opening said outlet when the fluid pressure in said discharge passage exceeds a predetermined level; and
a flow guide made from insulating material surrounding at least a portion of said movable contact, said flow guide being of such a length that it provides said closed condition for said fluid discharge passage.

2. A puffer type circuit interrupter comprising:
a chamber containing an arc extinguishing fluid;
a fixed contact in said chamber;
a movable contact in said chamber, said movable contact adapted to contact said fixed contact and to be movable away from said fixed contact in a first direction whereby an arc is formed;
means for moving said movable contact;
an arc space formed between said contacts when said movable contact is not contacting said fixed contact;
a constant volume pressure chamber connected to said arc space, said pressure chamber including a pressure valve, said pressure valve opening to communicate said pressure chamber with the area outside of said pressure chamber when the pressure therein exceeds a predetermined level;
a fluid discharge passage in said movable contact, said fluid discharge passage being closed until said movable contact has moved a predetermined distance in said first direction; and
a flow guide made from insulating material surrounding at least a portion of said movable contact, said flow guide being of such a length that it provides said closed condition for said fluid discharge passage.

3. A puffer type circuit interrupter comprising:
a chamber containing an arc extinguishing fluid;
a fixed contact in said chamber;
a movable contact in said chamber, said movable contact adapted to contact said fixed contact and to be movable away from said fixed contact in a first direction whereby an arc is formed;
means for moving said movable contact;
an arc space formed between said contacts when said movable contact is not contacting said fixed contact;
a constant volume pressure chamber connected to said arc space, said pressure chamber comprising plural pressure chamber means disposed in said first direction wherein each of said chamber means includes a circular cone shaped surface for guiding the flow of fluid therein;
a fluid discharge passage in said movable contact, said fluid discharge passage being closed until said movable contact has moved a predetermined distance in said first direction; and
a flow guide made from insulating material surrounding at least a portion of said movable contact, said flow guide being of such a length that it provides said closed condition for said fluid discharge passage.

4. A puffer type circuit interrupter comprising:
a chamber containing an arc extinguishing fluid;
a fixed contact in said chamber;
a movable contact in said chamber, said movable contact adapted to contact said fixed contact and to be movable away from said fixed contact in a first direction whereby an arc is formed;
means for moving said movable contact;
an arc space formed between said contacts when said movable contact is not contacting said fixed contact;
a constant volume pressure chamber connected to said arc space, said pressure chamber including at least one fin thereon;
a fluid discharge passage in said movable contact, said fluid discharge passage being closed until said movable contact has moved a predetermined distance in said first direction; and
a flow guide made from insulating material surrounding at least a portion of said movable contact, said flow guide being of such a length that it provides said closed condition for said fluid discharge passage.

5. A puffer type circuit interrupter comprising:
a chamber containing an arc extinguishing fluid;
a fixed contact in said chamber;
a movable contact in said chamber, said movable contact adapted to contact said fixed contact and to be movable away from said fixed contact in a first direction whereby an arc is formed;
means for moving said movable contact;
an arc space formed between said contacts when said movable contact is not contacting said fixed contact;
a constant volume pressure chamber connected to said arc space, said pressure chamber comprising a first pressure chamber means wherein the pressure of said fluid is raised for arc extinction by the arc generated in said arc space and a second pressure chamber means into which the high pressure fluid from said first chamber may be led for an extinction;
a fluid discharge passage in said movable contact, said fluid discharge passage being closed until said movable contact has moved a predetermined distance in said first direction; and
a flow guide made from insulating material surrounding at least a portion of said movable contact, said flow guide being of such a length that it provides said closed condition for said fluid discharge passage.

6. A puffer type circuit interrupter comprising:
a chamber containing an arc extinguishing fluid;
a fixed contact in said chamber;
a movable contact in said chamber, said movable contact adapted to contact said fixed contact and to be movable away from said fixed contact in a first direction whereby an arc is formed;
means for moving said movable contact;
an arc space formed between said contacts when said movable contact is not contacting said fixed contact;
a constant volume pressure chamber connected to said arc space;
a fluid discharge passage in said movable contact, said fluid discharge passage being closed until said movable contact has moved a predetermined distance in said first direction; and
a flow guide made from insulating material surrounding at least a portion of said movable contact, said flow guide being of such a length that it provides said closed condition for said fluid discharge passage;
wherein said pressure chamber and said arc space are connected by a narrow passage, said narrow passage including a gently curved constriction whereby the fluid passing therethrough is diffused.

7. A puffer type circuit interrupter comprising:
a chamber containing an arc extinguishing fluid;
a fixed contact in said chamber;
a movable contact in said chamber, said movable contact adapted to contact said fixed contact and to be movable away from said fixed contact in a first direction whereby an arc is formed;

means for moving said movable contact;

an arc space formed between said contacts when said movable contact is not contacting said fixed contact;

a constant volume pressure chamber located substantially entirely above, and connected to, said arc space;

a fluid discharge passage in said movable contact, said fluid discharge passage being closed until said movable contact has moved a predetermined distance in said first direction; and a flow guide made from insulating material surrounding at least a portion of said movable contact, said flow guide being of such a length that it provides said closed condition for said fluid discharge passage.

8. A circuit interrupter according to claims 2 or 3 or 4 or 5 or 6 or 7 wherein the discharge passage is formed by a partial hollow of the movable contact.

9. A circuit interrupter according to claim 8, wherein a nozzle is formed at the end of the movable contact.

10. A circuit interrupter according to claim 8 wherein said hollow forms an opening at the end of said movable contact and wherein a gas discharge passage is connected to the hollow opening.

11. A circuit interrupter according to claim 8 which further comprises plural gas outlets in said movable contact arranged in said first direction.

12. A circuit interrupter according to claim 2 wherein the pressure valve is disposed at upper part of the pressure chamber.

13. A circuit interrupter according to claim 2 wherein the upper surface of the pressure chamber is a slant surface and the pressure valve is disposed near the top of the slant surface.

14. A circuit interrupter according to claims 1 or 2 or 4 or 5 or 6 or 7 a circular cone shape surface for guiding the fluid flow of high pressure gas is disposed in the pressure chamber.

15. A circuit interrupter according to claim 3 wherein an opening for discharging the gas for arc extinction is formed at the top of the circular cone shape surface.

16. A circuit interrupter according to claims 1 or 2 or 3 or 4 or 5 or 6 the pressure chamber connected to the arc space is disposed in a shell for forming the arc space.

17. A circuit interrupter according to claims 1 or 2 or 3 or 4 or 5 or 6 or 7 the insulating flow guide is made of an arc resistant material.

18. A circuit interrupter according to claims 1 or 2 or 3 or 4 or 5 or 6 or 7 the pressure chamber is made of a heat conductive material.

19. A circuit interrupter according to claims 1 or 2 or 3 or 4 or 5 or 6 or 7 the pressure chamber is made of a metal.

20. A circuit interrupter according to claim 5 wherein the first pressure chamber means is surrounded by the second pressure chamber means and the first pressure chamber means is formed in a cylindrical shape.

21. A circuit interrupter according to claim 5 which comprises at least one opening between said second pressure chamber means and said fluid passage which is closed by the arc.

22. A circuit interrupter according to claim 5 which further comprises a gently constricted diffusion opening for diffusing the fluid for arc extinction between the arc space and the first pressure chamber.

23. A circuit interrupter according to claim 22 wherein the diffusion opening is formed by a single nozzle.

24. A circuit interrupter according to claim 5 which further comprises a counter-flow control means in a passage between the first and second pressure chamber means.

25. A circuit interrupter according to claim 24 wherein the counter-flow control means is formed in a circular cone shape.

26. The circuit interrupter of claim 5 wherein said first and second pressure chamber means are connected by a connecting passage and including a valve selectively opening and closing said connecting passage, said valve being open until a predetermined pressure is reached in said first pressure chamber means.

27. A circuit interrupter according to claim 26 wherein the valve has a valve body which is slidable on the inner surface of the first pressure chamber means and is resilient and is disposed to connect the first pressure chamber means and the second pressure chamber means in the normal state and the valve body is slidable to close the passage between the first and second pressure chamber means depending upon raising the pressure in the first pressure chamber means.

28. The circuit interrupter of claim 4 wherein said fin is located on the inside of said pressure chamber.

29. The circuit interrupter of claim 4 wherein said fin is located on the outside of said pressure chamber.

* * * * *